US011051553B2

(12) United States Patent
Jiang et al.

(10) Patent No.: US 11,051,553 B2
(45) Date of Patent: Jul. 6, 2021

(54) ATOMIZER WITH UPGRADED AIR PASSAGE STRUCTURE AND ELECTRONIC CIGARETTE HAVING SAME

(71) Applicant: Shenzhen First Union Technology Co., Ltd., Shenzhen (CN)

(72) Inventors: Zhanjun Jiang, Shenzhen (CN); Yonghai Li, Shenzhen (CN); Zhongli Xu, Shenzhen (CN)

(73) Assignee: Shenzhen First Union Technology Co., Ltd., Guangdong (CN)

( * ) Notice: Subject to any disclaimer, the term of this patent is extended or adjusted under 35 U.S.C. 154(b) by 316 days.

(21) Appl. No.: 16/012,757

(22) Filed: Jun. 19, 2018

(65) Prior Publication Data

US 2018/0360121 A1 Dec. 20, 2018

(30) Foreign Application Priority Data

Jun. 19, 2017 (CN) ..... 201720710217.0

(51) Int. Cl.
*A24F 40/485* (2020.01)
*A24F 40/10* (2020.01)

(52) U.S. Cl.
CPC ..... *A24F 40/485* (2020.01); *A24F 40/10* (2020.01)

(58) Field of Classification Search
None
See application file for complete search history.

(56) References Cited

U.S. PATENT DOCUMENTS

2014/0360516 A1* 12/2014 Liu ..... A61M 15/06 131/329
2015/0342255 A1* 12/2015 Wu ..... A61M 15/002 131/329

FOREIGN PATENT DOCUMENTS

CN 203 105 624 U 8/2013
CN 103 462 224 A 12/2013
CN 204 907 913 U 12/2015

* cited by examiner

*Primary Examiner* — Phu H Nguyen
(74) *Attorney, Agent, or Firm* — Proi Intellectual Property US; Klaus Michael Schmid

(57) ABSTRACT

An atomizer with an upgraded air passage structure includes a housing, a heating piece and an air passage disposed in the housing; the heating piece is disposed inside an atomizer chamber, a blocking piece is disposed in the air passage and configured for blocking an airflow; the blocking piece divides the air passage into an air inlet area and an air outlet area; the air outlet area and the air inlet area are both disposed at a different axial position with the atomizing chamber; the atomizing chamber is respectively communicated with the air inlet area and the air outlet area; the airflow in the air inlet area flows downwards to the atomizing chamber, then flows upwards to the air outlet area. An electronic cigarette having the aforementioned atomizer is further disclosed.

16 Claims, 4 Drawing Sheets

B-B

A-A

C-C

ATOMIZER WITH UPGRADED AIR PASSAGE STRUCTURE AND ELECTRONIC CIGARETTE HAVING SAME

TECHNICAL FIELD

The present disclosure relates to the field of electronic cigarettes, and particularly, to an atomizer with an upgraded air passage structure and an electronic cigarette having the same.

BACKGROUND ART

As people are increasingly aware of body health, people are realizing the endangering of tobacco to the body health, therefore an electronic cigarette appeared. An atomizer of the electronic cigarette generally heats the tobacco liquid to generate an aerosol then sucked by users, in a process that the tobacco liquid is aerosolized some hazardous material such as tars won't be produced, which may greatly reduce a rate of endangering to users' bodies.

To pursue the most fast air passage, currently the atomizer in the prior art utilizes a type of a straight-through air passage, that is, an air inlet is disposed below or over an atomizing chamber where the heating piece is disposed therein. Taking the air inlet disposed below the atomizing chamber as an example, exterior air is sucked via the lower air inlet, flowing upward and passing through the atomizing chamber, then straight-through flowing upward, and sucked via a top air outlet, of which the air inlet is closer to the above heating piece. In a process that the user sucks or in a comparatively long time between every two times of sucking, the tobacco liquid condense in the atomizing chamber, the above straight-though air passage would make the condensing tobacco liquid leak out from the air inlet or the air outlet, therefore causing pollution of the tobacco liquid.

SUMMARY

In view of the drawbacks in the electronic cigarette and the atomizer thereof known to the inventors, the present disclosure generally relates to an atomizer with an upgraded air passage structure and an electronic cigarette having the same, reducing a rate of the condensing tobacco liquid leaking out from the air passage.

To overcome the above shortages, the present disclosure relates to the atomizer with the upgraded air passage structure including a housing, a heating piece and an air passage disposed in the housing; the heating piece is disposed inside an atomizer chamber, a blocking piece is disposed in the air passage and configured for blocking an airflow. The blocking piece divides the air passage into an air inlet area and an air outlet area; the air outlet area and the air inlet area are both disposed at a different axial position with the atomizing chamber. The atomizing chamber is respectively communicated with the air inlet area and the air outlet area. The airflow in the air inlet area flows downwards to the atomizing chamber, then flows upwards to the air outlet area.

Furthermore, a first air inlet is disposed on the housing and at an axial position above the blocking piece.

More specifically, the first air inlet is disposed on a side wall of the housing, communicated with the air inlet area via an air pipe inside the side wall of the housing.

Furthermore, the air inlet area has a second air inlet communicated with the atomizing chamber, the second air inlet and the first air inlet are staggered in a certain angle.

Furthermore, the air outlet area has a first air inlet communicated with the atomizing chamber; the first air outlet and the second air inlet are disposed at two sides of the atomizing chamber.

Furthermore, a top of the housing has a second air outlet, the second air outlet and the first air outlet are staggered in a certain angle.

Preferably, a stagger angle between the second air outlet and the first air outlet is 90 degree; and a stagger angle between the second air inlet and the first air inlet is 90 degree.

Furthermore, the blocking piece at comprises a silicone seat and a base; the air inlet area and the air outlet area are defined by the silicone seat matching with the base and a supporter for fixing the heating piece; where the atomizing chamber is defined by the base and the supporter for fixing the heating piece; a bottom of the base has a recessed shape, used for accumulating a certain amount of the tobacco liquid.

As one specific embodiment, a protuberant separating bar is formed on a surface of the blocking piece; the separating bar is integrally manufactured with the silicone seat; the separating bar defines the air inlet area and the air outlet area by dividing a space between the housing and the liquid storage cup into two side areas.

As a specific embodiment, a center of the housing has a liquid storage cup, a bottom end of the liquid storage cup has an opening; the air passage is defined by areas surrounding and below the liquid storage cup.

Furthermore, an electronic cigarette has the aforementioned atomizer with an upgraded air passage structure, and a power supply for supplying power to the atomizer.

Additional aspects and advantages of the present disclosure will be: the atomizer of the electronic cigarette refers to the upgraded air passage, a part of the air passage is divided into independent air inlet area and air outlet area via the blocking piece. The air inlet area and the air outlet area are disposed at an axial position above the atomizing chamber, allowing the air inlet passage and the air outlet passage being disposed at one same axial position that is above the atomizing chamber, which replaces the existing design of inletting air from an axial position below the atomizing chamber, to reduce the rate of leakage of the tobacco liquid in the atomizing chamber. Meanwhile, the independent air inlet area and the air outlet area are disposed at one same axial position that is different with the atomizing chamber, not the straight-through type, with the staggered air inlets/outlets to prolong the whole air passage further to avoid the condensing tobacco liquid in the atomizing chamber leaking out, therefore the condensing tobacco liquid may be heated and aerosolized for multiple times.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
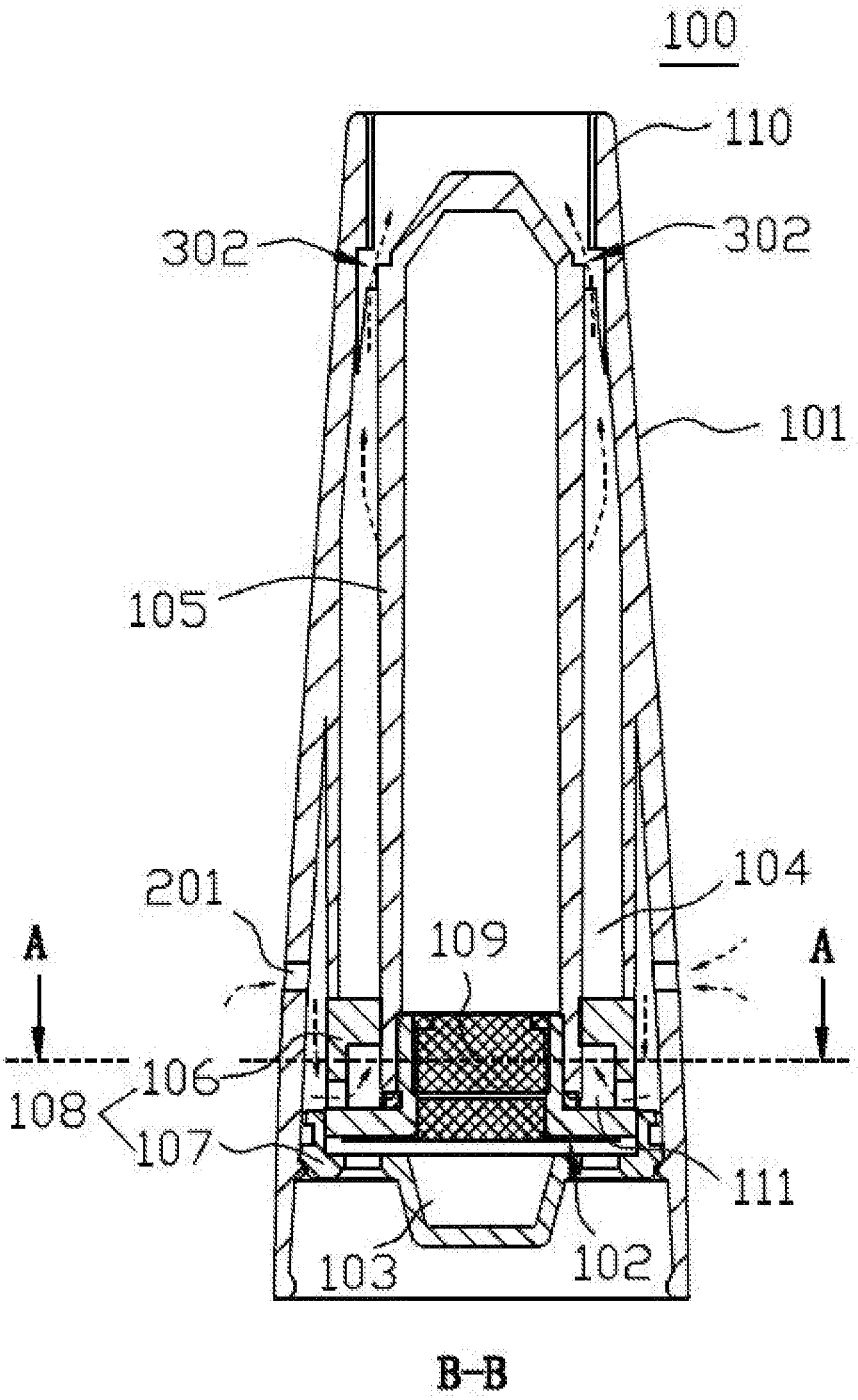
FIG. 1 is an axial sectional view of an atomizer of an electronic cigarette along a direction of B-B according to an embodiment of the present disclosure.
Figure 2:
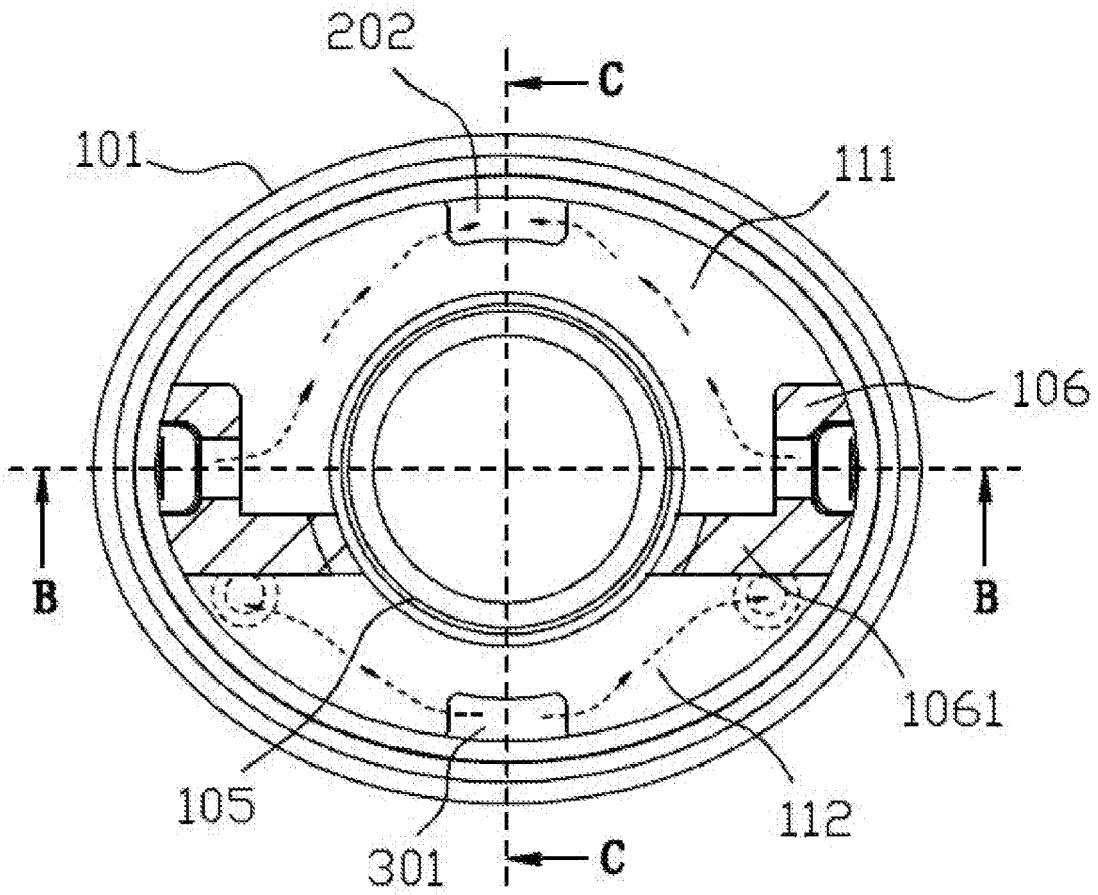
FIG. 2 is a cross-sectional view of the atomizer of the electronic cigarette along a direction of A-A according to an embodiment of the present disclosure.
Figure 3:
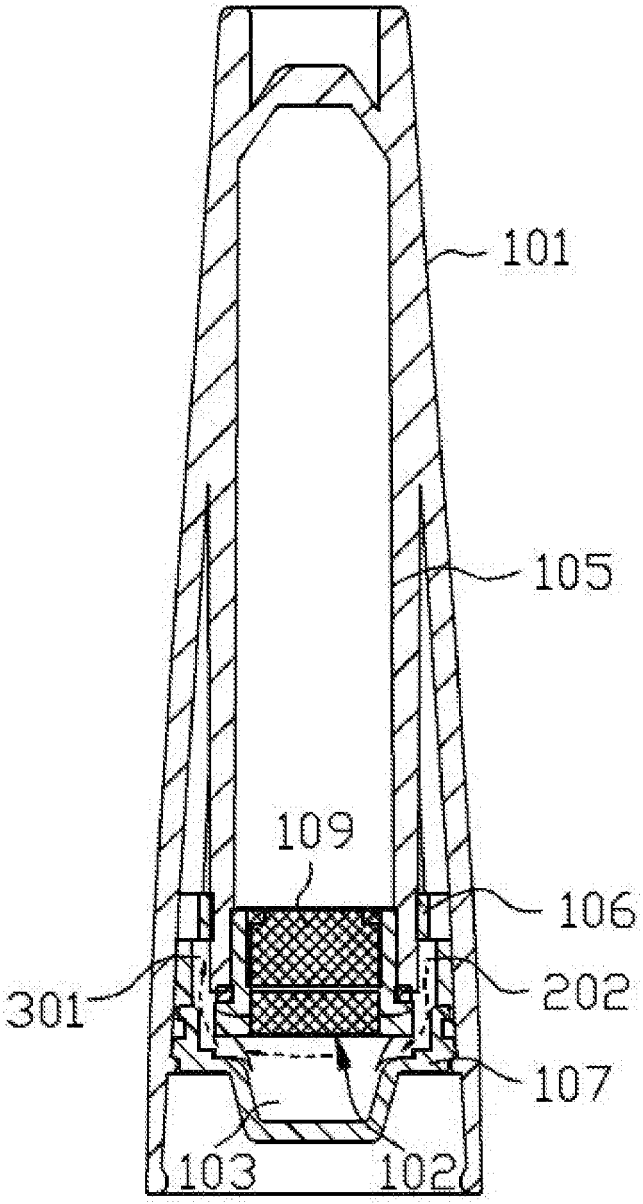
FIG. 3 is an axial sectional view of the atomizer of the electronic cigarette along a direction of C-C according to an embodiment of the present disclosure.

Referring to FIG. 1, FIG. 2 and FIG. 3, the present disclosure relates to an atomizer of an electronic cigarette 100 with an upgraded air passage, including a housing 101, a heating piece 102 and an air passage 104 disposed inside the housing 101; the heating piece 102 is disposed inside the atomizing chamber 103 and configured for heating the tobacco liquid to generate an aerosol in the atomizing chamber 103. A top of the housing 101 has a mouth piece 110 for a user to suck the aerosol, the mouth piece 110 is in communication with the atomizing chamber 103.

As an upgraded design in the embodiment, a blocking piece 108 is disposed below the air passage 104 and configured for blocking an airflow. The blocking piece 108 divides the air passage into an air inlet area 111 and an air outlet area 112 (with reference to FIG. 2). The air inlet area 111 and the air outlet area 112 are correspondingly communicated with the air inlet and the air outlet, as concretely described hereinafter. The air outlet area 112 and the air inlet area 111 are respectively disposed at a different axial position with the atomizing chamber 103. The atomizing chamber 103 is respectively communicated with the air inlet area 111 and the air outlet area 112. When the user sucks the aerosol via the mouth piece 110, the airflow in the air inlet area 111 flows downwards to the atomizing chamber 103, then flows upwards to the air outlet area 112, which avoids the tobacco liquid condensing in the atomizing chamber 103 easily leaking out from the air inlets and the air outlets, whereas, the condensing tobacco liquid is accumulated in the atomizing chamber 103 in favor of reheating, re-aerosolizing and recycling for multiple times.

The above blocking piece 108 at least includes a silicone seat 106 and a base 107. The above air inlet area 111 and the air outlet area 112 are formed by a specialized shape and structure of the silicone seat 106 matching with the base 107, and a supporter for fixing the heating piece 102. Meanwhile the above atomizing chamber 103 is formed by the base 107 and the supporter for fixing the heating piece 102. A bottom of the base 107 has a recessed shape, used for accumulating a certain amount of the tobacco liquid.

More specifically, a protuberant separating bar 1061 is formed on a surface of the blocking piece 108. The separating bar 1061 is integrally manufactured with the above silicone seat 106. The separating bar 1061 divides a circular space between the housing 101 and the liquid storage cup 105 into two side areas of left and right, that is, the air inlet area 111 and the air outlet area 112.

In terms of the air inlet structure, a first air inlet 201 is formed on the housing 101, at an axial position above the blocking piece 108. The first air inlet 201 is located at the axial position above the blocking piece 108 and the atomizing chamber 103, avoiding the tobacco liquid leaking from a lower end of atomizer 100 when the atomizer 100 is placed at a normal state. As a preferred embodiment, the first air inlet 201 is disposed on a side wall of the housing 101, as shown in FIG. 1, the number of the first air inlets 201 is two, both are dispersed on two side walls of the housing 101 and communicated with the air inlet area 111 via an air pipe extending downward, inside the side wall of the housing 101.

With reference to FIG. 2, the air inlet area 111 has a second air inlet 202 communicated with the atomizing chamber 103 at a lower axial position. The second air inlet 202 and the first air inlet 201 are staggered to a certain angle along a horizontal direction, in a preferred embodiment, the angle is 90 degree. The setting of the second air inlet 202 and the first air inlet 201 being staggered may prolong the whole air inlet passage to reduce a rate of the tobacco liquid leaking out from the atomizing chamber.

In terms of the air outlet structure, the air outlet area 112 has a first air outlet 301 communicated with the atomizing chamber 103. The first air outlet 301 and the second air inlet 202 are disposed at two sides of the atomizing chamber 103. As a preferred embodiment, the first air outlet 301 and the second air inlet 202 are symmetrically disposed at two sides of the mid-positioned heating piece 102.

A top of the housing 101 has a second air outlet 302, the second air outlet 302 is communicated with an air outlet passage extending upwards and a mouth piece 110 at an upper axial position. The second air outlet 302 and the first air outlet 301 are staggered in a certain angle. In the embodiment, a stagger angle between the second air outlet 302 and the first air outlet 301 is 90 degree, enabling the second air outlet 302 and the above first air inlet 201 disposed at a same axial section B-B, and the air inlet passage and the air outlet passage are separated by the separating bar 1061 of the blocking piece 108. Similarly, the second air outlet 302 and the first air outlet 301 being staggered to set may prolong the air passage and reduce a rate of the tobacco liquid leaking out of the atomizing chamber.

As shown from FIG. 1 to FIG. 3, of which dash lines represent the air passing path, when the user sucks air, the exterior air flows into the atomizer 100 via the first air inlet 201 that is disposed on the side wall of the housing 101, then flows downwards. After blocked by the blocking piece 108 the air flows transversely into the air inlet area 111. After blocked by the separating bar 1061, the air in the air inlet area 111 spins 90 degree then flows into the second air inlet 202, flowing downwards to the atomizing chamber 103 from the second air inlet 202.

Continue from the above air inlet passage and introduce the following: the air carrying the aerosol generated by the tobacco liquid in the atomizing chamber 103 flows from the other side of the atomizing chamber 103 upwards to air outlet area 112 via the first air outlet 301. Since a passage right there above the first air outlet 301 is closed, the air is blocked by the closed passage continues spinning 90 degree to flow upwards to the second air outlet 302, ultimately sucked out from the mouth piece 110.

Referring to FIG. 1 again, the liquid storage cup 105 is set at a center of the housing 101, a bottom end of the liquid storage cup 105 has an opening; the side wall of the liquid storage cup is integrally manufactured with the housing 101, the liquid storage cup 105 has a chamber for storing the tobacco liquid. The air passage is defined by areas surrounding and below the liquid storage cup 105. The above air inlet area 111, the air outlet area 112 and the atomizing chamber 103 forms as a part of the air passage.

As a preferred embodiment, the opening at the bottom end of the liquid storage cup 105 is filled up with a tobacco conducting layer 109, the heating piece 102 contacts a surface of the tobacco conducting layer 109. The tobacco conducting layer 109 is made of any one of fiber cottons, non-woven fabrics and micro-porous materials such as polymer foam materials or micro-porous ceramics, used for providing tobacco liquid to the heating piece 102 at a certain oozing speed. In some embodiments, the heating piece 102 is a heating piece or net.

Figure 4:
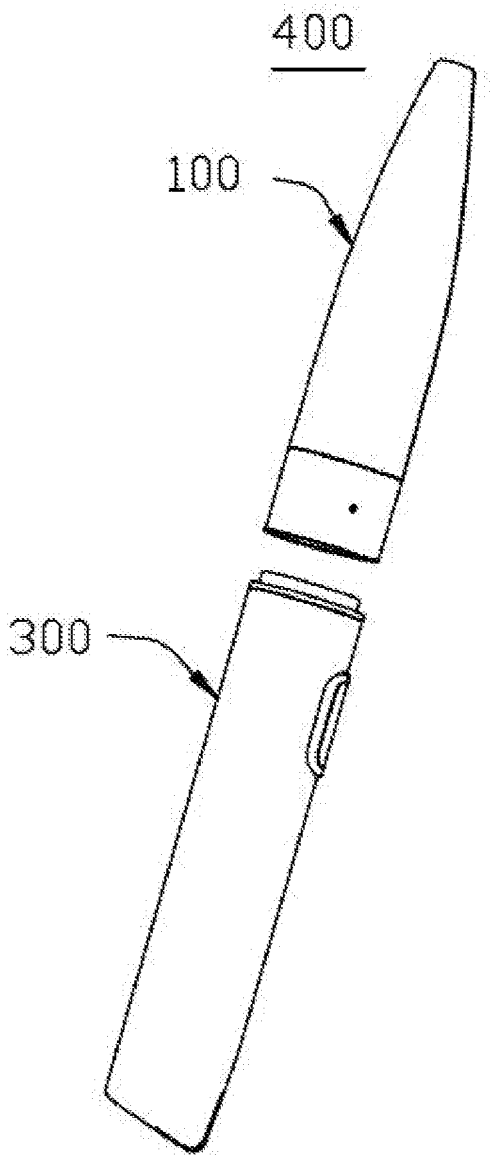
FIG. 4 is view of an electronic cigarette which includes an atomizer according to an embodiment of the present disclosure.

Referring to FIG. 4, an electronic cigarette 400 is further disclosed in accordance with the present disclosure, which includes the aforementioned atomizer 100 with the upgraded air passage structure and a power supply 300 for supplying power to the atomizer 100. The atomizer 100 and the power supply 300 may be detachably connected by a screw threaded, a snap joint or a magnetic attraction etc.

Terminology used herein is for the purpose of describing particular embodiments only and is not intended to be limiting of the invention. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer with an upgraded air passage structure comprising:

a housing;

a heating piece; and an air passage disposed in the housing; the heating piece is disposed inside an atomizer chamber, a blocking piece is disposed in the air passage and configured for blocking an airflow; the blocking piece divides the air passage into an air inlet area and an air outlet area; the air outlet area and the air inlet area are both disposed at an axial position that is different with the atomizing chamber; the atomizing chamber is respectively communicated with the air inlet area and the air outlet area; the air in the air inlet area flows downwards to the atomizing chamber, then flows upwards to the air outlet area;

wherein a first air inlet is disposed on the housing; the air inlet area comprises a second air inlet communicated with the atomizing chamber that is at a lower axial position, the second air inlet and the first air inlet are staggered along a horizontal direction;

wherein the air outlet area has a first air outlet communicated with the atomizing chamber: the first air outlet and the second air inlet are disposed at two sides of the atomizing chamber.

2. The atomizer according to claim 1, wherein the first air inlet is disposed at an axial position above the blocking piece.

3. The atomizer according to claim 2, wherein the first air inlet is disposed on a side wall of the housing, communicated with the air inlet area via an air pipe inside the side wall of the housing.

4. The atomizer according to claim 1, wherein a top of the housing has a second air outlet, the second air outlet and the first air outlet are staggered along a horizontal direction.

5. The atomizer according to claim 4, wherein a stagger angle between the second air outlet and the first air outlet is 90 degree; and a stagger angle between the second air inlet and the first air inlet is 90 degree.

6. The atomizer according to claim 1, wherein the blocking piece comprises a silicone seat and a base; the air inlet area and the air outlet area are defined by the silicone seat matching with the base and a supporter for fixing the heating piece; where the atomizing chamber is defined by the base and the supporter for fixing the heating piece; a bottom of the base has a recessed shape, used for accumulating a certain amount of the tobacco liquid.

7. The atomizer according to claim 6, wherein a protuberant separating bar is formed on a surface of the blocking piece; the separating bar is integrally manufactured with the silicone seat; the separating bar defines the air inlet area and the air outlet area by dividing a space between the housing and the liquid storage cup into two side areas.

8. The atomizer according to claim 1, wherein a center of the housing has a liquid storage cup, a bottom end of the liquid storage cup has an opening; the air passage is defined by areas surrounding and below the liquid storage cup.

9. An electronic cigarette comprising:

an atomizer with an upgraded air pipe structure comprising:

a housing;

a heating piece; and an air passage disposed in the housing; the heating piece is disposed inside an atomizer chamber, a blocking piece is disposed in the air passage and configured for blocking an airflow; the blocking piece divides the air passage into an air inlet area and an air outlet area; the air outlet area and the air inlet area are both disposed at an axial position that is different with the atomizing chamber; the atomizing chamber is respectively communicated with the air inlet area and the air outlet area; the air in the air inlet area flows downwards to the atomizing chamber, then flows upwards to the air outlet area; and a power supply configured for supplying power to the atomizer;

wherein a first air inlet is disposed on the housing; the air inlet area comprises a second air inlet communicated with the atomizing chamber that is at a lower axial position, the second air inlet and the first air inlet are staggered along a horizontal direction;

wherein the air outlet area has a first air outlet communicated with the atomizing chamber: the first air outlet and the second air inlet are disposed at two sides of the atomizing chamber.

10. The electronic cigarette according to claim 9, wherein the first air inlet is disposed at an axial position above the blocking piece.

11. The electronic cigarette according to claim 10, wherein the first air inlet is disposed on a side wall of the housing, communicated with the air inlet area via an air pipe inside the side wall of the housing.

12. The electronic cigarette according to claim 9, wherein a top of the housing has a second air outlet, the second air outlet and the first air outlet are staggered along a horizontal direction.

13. The electronic cigarette according to claim 12, wherein a stagger angle between the second air outlet and the first air outlet is 90 degree; and a stagger angle between the second air inlet and the first air inlet is 90 degree.

14. The electronic cigarette according to claim 9, wherein the blocking piece comprises a silicone seat and a base; the air inlet area and the air outlet area are defined by the silicone seat matching with the base and a supporter for fixing the heating piece; where the atomizing chamber is defined by the base and the supporter for fixing the heating piece; a bottom of the base has a recessed shape, used for accumulating a certain amount of the tobacco liquid.

15. The electronic cigarette according to claim 14, wherein a protuberant separating bar is formed on a surface of the blocking piece; the separating bar is integrally manufactured with the silicon silicone seat; the separating bar defines the air inlet area and the air outlet area by dividing a space between the housing and the liquid storage cup into two side areas.

16. The electronic cigarette according to claim 9, wherein a center of the housing has a liquid storage cup, a bottom end of the liquid storage cup has an opening; the air passage is defined by areas surrounding and below the liquid storage cup.

* * * * *